US011125418B2

(12) United States Patent
Freeland et al.

(10) Patent No.: US 11,125,418 B2
(45) Date of Patent: Sep. 21, 2021

(54) MODULAR DEVICE WITH INTERCHANGEABLE TORCH LANTERN FUNCTIONALITIES

(71) Applicants: Brian Freeland, Chandler, AZ (US); Yanbei Qin, Zhejiang (CN)

(72) Inventors: Brian Freeland, Chandler, AZ (US); Yanbei Qin, Zhejiang (CN)

(73) Assignee: SHAWSHANK LEDZ INC., Gilbert, AZ (US)

( * ) Notice: Subject to any disclaimer, the term of this patent is extended or adjusted under 35 U.S.C. 154(b) by 15 days.

(21) Appl. No.: 16/691,620

(22) Filed: Nov. 22, 2019

(65) Prior Publication Data

US 2021/0156544 A1 May 27, 2021

(51) Int. Cl.

| | |
|---|---|
| ***F21V 17/00*** | (2006.01) |
| ***F21V 15/01*** | (2006.01) |
| ***F21V 21/40*** | (2006.01) |
| ***F21L 4/08*** | (2006.01) |
| ***F21V 21/10*** | (2006.01) |
| ***F21S 6/00*** | (2006.01) |
| ***F21S 9/03*** | (2006.01) |
| *F21W 121/00* | (2006.01) |

(52) U.S. Cl.

CPC ..... *F21V 17/002* (2013.01); *F21L 4/08* (2013.01); *F21S 6/005* (2013.01); *F21S 9/03* (2013.01); *F21V 15/01* (2013.01); *F21V 21/10* (2013.01); *F21V 21/406* (2013.01); *F21W 2121/00* (2013.01)

(58) Field of Classification Search

CPC ..... F21V 17/002; F21V 21/406; F21V 15/01; F21V 21/10; F21L 4/08; F21S 9/03; F21S 6/005; F21W 2121/00

See application file for complete search history.

(56) References Cited

U.S. PATENT DOCUMENTS

| | | | |
|---|---|---|---|
| 3,868,177 | A | 2/1975 | Glass et al. |
| 4,004,132 | A | 1/1977 | Glass et al. |
| 4,360,860 | A | 11/1982 | Johnson et al. |

(Continued)

FOREIGN PATENT DOCUMENTS

| | | | |
|---|---|---|---|
| CN | 201121804 | Y | 9/2008 |
| CN | 205716591 | U | 11/2016 |

(Continued)

*Primary Examiner* — Tsion Tumebo

(74) *Attorney, Agent, or Firm* — Legalforce RAPC Worldwide

(57) ABSTRACT

A modular device includes a light housing configured to receive a light source thereon, and a central housing, decoratively patterned and configured to be connected to the light housing such that, in a state of the connection of the light housing with the received light source to the central housing, the light source is also received through the central housing and encompassed by the central housing with the decorative patterning thereon. The central housing is configured to be capable of being connected to each of a handle element and a base element such that the modular device is capable of being used as a torch when the handle element is connected to the central housing, and the modular device is capable of being used as a lantern when the base element is connected to the central housing.

17 Claims, 10 Drawing Sheets

(56) References Cited

U.S. PATENT DOCUMENTS

| | | | | |
|---|---|---|---|---|
| 4,502,102 | A * | 2/1985 | Phipps | F21L 4/005 362/183 |
| 6,082,877 | A * | 7/2000 | Hughes | F21S 6/005 362/152 |
| 6,179,431 | B1 | 1/2001 | Chien | |
| 6,206,542 | B1 | 3/2001 | Case | |
| 6,761,466 | B1 * | 7/2004 | Cheng | A63H 37/00 362/109 |
| 6,953,260 | B1 | 10/2005 | Allen | |
| 7,513,638 | B2 * | 4/2009 | Allsop | F21S 9/037 362/183 |
| 8,556,449 | B1 | 10/2013 | Matys | |
| 8,651,688 | B1 | 2/2014 | Golden | |
| D738,021 | S | 9/2015 | Wang | |
| 9,631,800 | B2 * | 4/2017 | Coughlin | F21V 21/14 |
| 9,689,544 | B2 * | 6/2017 | Green, Jr. | F21S 10/043 |
| 9,927,077 | B1 | 3/2018 | Fowkes et al. | |
| 10,267,484 | B2 * | 4/2019 | Qiu | F21V 17/00 |
| 10,371,326 | B2 * | 8/2019 | Grandadam | H05K 1/144 |
| 2005/0146874 | A1 * | 7/2005 | Cech | F21S 8/081 362/253 |
| 2006/0279956 | A1 * | 12/2006 | Richmond | F21V 15/01 362/374 |
| 2007/0159835 | A1 * | 7/2007 | Swanson | F21S 6/005 362/410 |
| 2008/0074867 | A1 * | 3/2008 | Chen | H05B 45/00 362/183 |
| 2009/0135611 | A1 | 5/2009 | Lin | |
| 2009/0284966 | A1 | 11/2009 | Crookham et al. | |
| 2011/0058361 | A1 | 3/2011 | Houghton | |
| 2012/0113629 | A1 * | 5/2012 | Steele | F21V 21/06 362/190 |
| 2012/0243213 | A1 * | 9/2012 | Chen | F21V 23/04 362/183 |
| 2015/0338040 | A1 * | 11/2015 | Swope | F21V 5/008 362/183 |
| 2016/0084485 | A1 * | 3/2016 | Bowcutt | F21L 4/00 362/191 |
| 2016/0327227 | A1 * | 11/2016 | Green, Jr. | F21S 10/043 |
| 2018/0163935 | A1 | 6/2018 | Fowkes et al. | |
| 2018/0299084 | A1 * | 10/2018 | Chien | F21V 14/08 |
| 2019/0226652 | A1 * | 7/2019 | Chien | H01R 33/92 |

FOREIGN PATENT DOCUMENTS

| | | | |
|---|---|---|---|
| CN | 205807010 | U | 12/2016 |
| GB | 2143630 | A | 2/1985 |
| KR | 101800971 | B1 | 11/2017 |
| WO | 2019040734 | A1 | 2/2019 |

* cited by examiner

MODULAR DEVICE WITH INTERCHANGEABLE TORCH LANTERN FUNCTIONALITIES

FIELD OF TECHNOLOGY

This disclosure relates generally to illumination devices, and, more particularly, to a method, a device and/or a system of a modular device with interchangeable torch-lantern functionalities.

BACKGROUND

An illumination device (e.g., a lamp) may include a light source configured to illuminate an external environment thereof. The illumination device may include components that are prone to damage. Replacement thereof in the event of damage may prove to be expensive, especially when the illumination device is constituted by expensive components integrally formed therewith. Moreover, such a configuration of the illumination device may make it difficult for a user thereof to exercise his/her preferences with regard to replacing one or more component(s) constituting illumination device. Further, the configuration of the illumination device may limit use thereof to specific settings. For example, the user may have to use one illumination device toward utilitarian ends and another illumination device with a different configuration toward aesthetic ends.

SUMMARY

Disclosed are a method, a device and/or a system of a modular device with interchangeable torch-lantern functionalities.

In one aspect, a modular device includes a light housing configured to receive a light source thereon, and a central housing, decoratively patterned and configured to be connected to the light housing such that, in a state of the connection of the light housing with the received light source to the central housing, the light source is also received through the central housing and encompassed by the central housing with the decorative patterning thereon.

A bottom surface of the central housing farthest away from the light housing includes a patterned formation thereon configured to enable connection of each of a handle element and a base element to the central housing based on the each of the handle element and the base element having a pattern on a top surface thereof that is complementary to the patterned formation on the bottom surface of the central housing such that the modular device is capable of being used as a torch when the handle element is connected to the central housing, and the modular device is capable of being used as a lantern when the base element is connected to the central housing.

The handle element includes a stem portion configured to be held by a hand of a user of the modular device and/or received through a receptacle, and the base element is configured to enable placement of the lantern on a flat surface based on appropriate surface contact between a bottom surface of the base element and the flat surface.

In another aspect, a method of a modular device includes forming the modular device based on providing a light housing configured to receive a light source thereon, and providing a central housing, decoratively patterned and configured to be connected to the light housing such that, in a state of the connection of the light housing with the received light source to the central housing, the light source is also received through the central housing and encompassed by the central housing with the decorative patterning thereon.

The method also includes providing a capability to the formed modular device to be used both as a torch and a lantern based on providing a patterned formation on a bottom surface of the central housing farthest away from the light housing compatible with a complementary pattern on a top surface of each of a handle element and a base element. The handle element includes a stem portion configured to be held by a hand of a user of the modular device and/or received through a receptacle, and the base element is configured to enable placement of the lantern on a flat surface based on appropriate surface contact between a bottom surface of the base element and the flat surface.

Providing the capability to the formed modular device to be used both as the torch and the lantern also includes connecting the handle element to the central housing based on the complementary patterns thereon to enable the use of the modular device as the torch, and connecting the base element to the central housing based on the complementary patterns thereon to enable the use of the modular device as the lantern.

In yet another aspect, a method of a modular device includes forming the modular device based on providing a light housing configured to receive a light source thereon, and providing a central housing, decoratively patterned and configured to be connected to the light housing such that, in a state of the connection of the light housing with the received light source to the central housing, the light source is also received through the central housing and encompassed by the central housing with the decorative patterning thereon.

The method also includes providing a patterned formation on a bottom surface of the central housing of the modular device farthest away from the light housing compatible with a complementary pattern on a top surface of each of a handle element and a base element. The handle element includes a stem portion configured to be held by a hand of a user of the modular device and/or received through a receptacle, and the base element is configured to enable placement of the modular device on a flat surface based on appropriate surface contact between a bottom surface of the base element and the flat surface.

Further, the method includes connecting the handle element or the base element to the central housing based on the complementary patterns thereon to enable use of the modular device as a torch or a lantern, and replacing the handle element or the base element connected to the central housing with the corresponding base element or the handle element based on the complementary patterns thereon to enable use of the modular device as the corresponding lantern or the torch.

The methods and systems disclosed herein may be implemented in any means for achieving various aspects. Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

Example embodiments, as described below, may be used to provide a method, a device and/or a system of a modular device with interchangeable torch-lantern functionalities. It will be appreciated that the various embodiments discussed herein need not necessarily belong to the same group of exemplary embodiments, and may be grouped into various other embodiments not explicitly disclosed herein. In the following description, for purposes of explanation, numerous specific details are set forth in order to provide a thorough understanding of the various embodiments.

Figure 1:
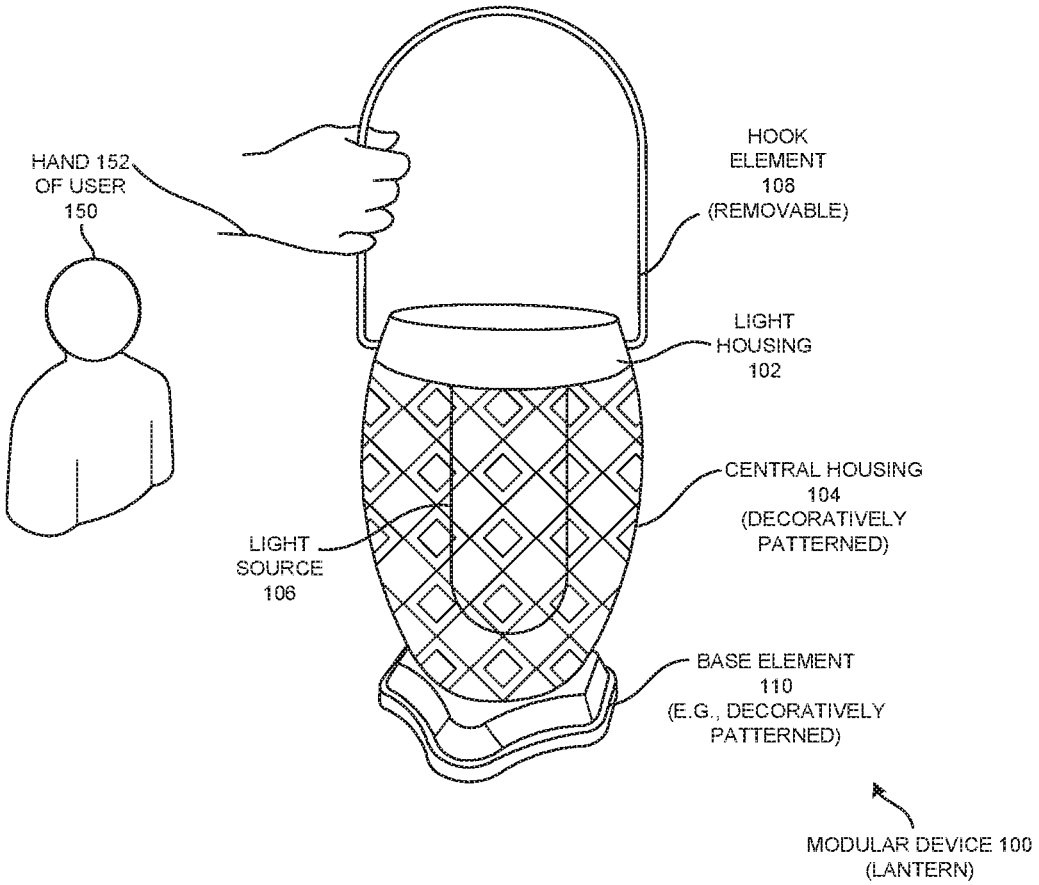
FIG. 1 is an illustrative view of a modular device in a lantern configuration, according to one or more embodiments.

FIG. 1 shows a modular device 100 in a lantern configuration, according to one or more embodiments. In one or more embodiments, the adjective "modular" in modular device 100 may be understood as a quality related to constituent parts that are capable of being independently created and combined as a whole to form modular device 100. In one or more embodiments, modular device 100 may include a light housing 102 configured to receive a light source 106 therein. In one or more embodiments, light housing 102 may be a component made of a material including but not limited to metal, plastic, wood and an alloy. In one or more embodiments, said light housing 102 may include a surface thereof configured to form a top surface of a lantern formed by modular device 100.

In one or more embodiments, light housing 102 may include patterns thereon (to be discussed below) configured to enable reception of light source 106 therein. In one or more embodiments, light source 106 may be a lamp (e.g., based on Light Emitting Diode (LED) technology) configured to provide illumination to an environment external thereto. It should be noted that light source 106 may include a number of individual light sources therein. In one or more embodiments, light source 106, like light housing 102, may be a module of modular device 100.

In one or more embodiments, modular device 100 may include a central housing 104 configured to be connected to light housing 102 with light source 106 received therein. In one or more embodiments, light housing 102 with light source 106 received therein may be seen as a unit configured to be connected to central housing 104. In one or more embodiments, in addition to the patterns (to be discussed below) on light housing 102 to receive light source 106 therein, light housing 102 may include secondary patterns (not shown in FIG. 1) complementary to patterns (not shown) on central housing 104 to enable connection of light housing 102 with light source 106 thereto.

In one or more embodiments, in a state of the connection of light housing 102 with the received light source 106 to central housing 104, light source 106 may be received through central housing 104 and encompassed thereby (i.e., central housing 104), as shown in FIG. 1. In one or more embodiments, as also shown in FIG. 1, central housing 104 may be decoratively patterned to enable light from light source 106 to provide controlled illumination to the environment surrounding modular device 100.

In one or more embodiments, the decorative patterns on central housing 104 may not be limited to one decorative pattern. As, in one or more embodiments, central housing 104 may also be a module, replaceability thereof may manifest in the form of central housing 104 of the one decorative pattern being changed into another central housing 104 of another decorative pattern. In certain embodiments, central housing 104 may be envisioned as a main frame (not shown) with even the decorative pattern capable of being replaced with another decorative pattern, along with the main frame. In this case, the main frame and a barrier (with the decorative pattern) of central housing 104 encompassing light source 106 both may be considered as distinct modules.

In one or more embodiments, central housing 104 may be made of a material (e.g., metal, wood, plastic) with the decorative patterns integrally formed therewith. In this case, portions of central housing 104 without the decorative patterns may be transparent to allow light from light source 106 encompassed by central housing 104 illuminate the external environment of modular device 100. In one or more other embodiments, the decorative pattern may be made of translucent/semi-transparent material (e.g., thin plastic, paper, semi-transparent sheet) and coupled to central housing 104 to encompass light source 106 in the state of connection of central housing 104 to light housing 102. Thus, in one or more embodiments, the external environment of modular device 100 may be illuminated by light source 106 in a controlled manner.

In one or more embodiments, central housing 104 may also be coupled to a base element 110 (e.g., also decoratively patterned) at an end thereof opposite to an end of coupling of central housing 104 to light housing 102. In other words, in one or more embodiments, a bottom surface (to be discussed below) of central housing 104 farthest away from light housing 102 may include a patterned formation (to be discussed below) thereon configured to enable connection of said base element 110 to central housing 104. In one or more embodiments, the aforementioned connection may be based on base element 110 having a pattern (to be discussed below) on a top surface (to be discussed below) thereof that is complementary to the patterned formation (to be discussed below) on the bottom surface (to be discussed below) of central housing 104.

In one or more embodiments, modular device 100 may be capable of being used as a lantern when base element 110 is connected to central housing 104, as discussed above. In one or more embodiments, base element 110 may be configured to enable placement of modular device 100 in the lantern configuration on a flat surface (to be discussed below) based on an appropriate surface contact between a bottom surface (to be discussed below) of base element 110 and the flat surface.

In one or more embodiments, modular device 100 in the lantern configuration may be portable. In one or more embodiments, modular device 100 may rendered more portable based on providing a holding means for the lantern connected to light housing 102 at an outer portion thereof. As shown in FIG. 1, said holding means may be implemented as a hook element 108 secured to light housing 102 at the outer portion thereof. In one example implementation, the aforementioned hook element 108 may be secured to the outer portion of light housing 102 based on diametrically opposite holes therein. In one or more embodiments, hook element 108 may enable modular device 100 to be held upright through a hand 152 of a user 150 thereof, and hung on a hanging element (to be discussed below). In one or more embodiments, hook element 108 may be removably attached to light housing 102.

In one or more embodiments, the provision of hook element 108 or removability thereof may enable multiple applications of the lantern configuration of modular device 100. In one example, the lantern may be carried by user 150 using hook element 108 for utilitarian purposes. In another example, the lantern may be placed in a room for decorative purposes; here, hook element 108 may be removed or not even provided. All reasonable variations are within the scope of the exemplary embodiments discussed herein.

Figure 2:
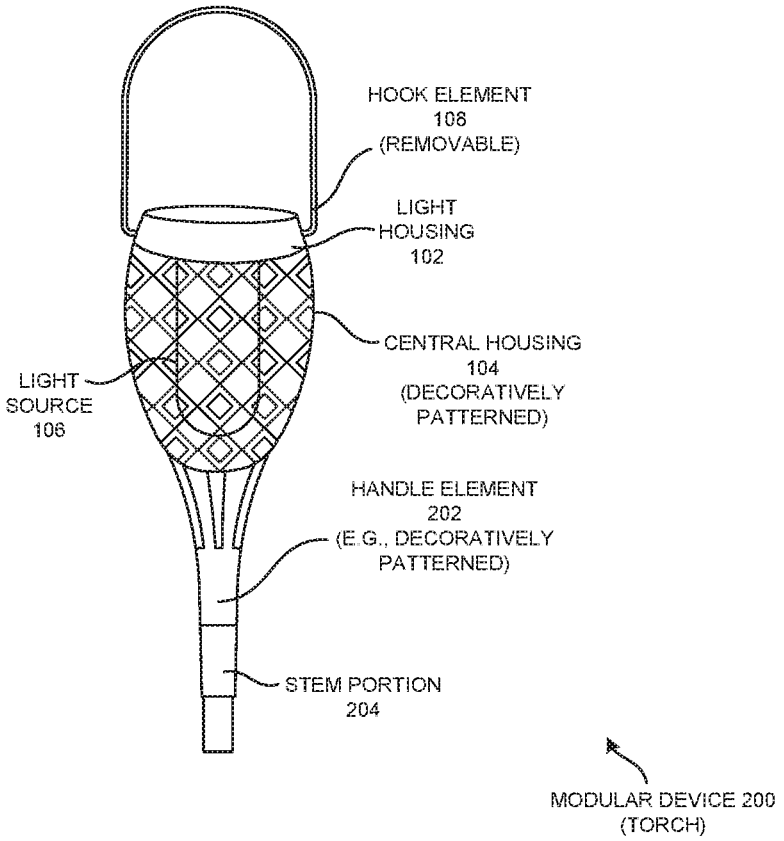
FIG. 2 is an illustrative view of a modular device in a torch configuration, according to one or more embodiments.

FIG. 2 shows a modular device 200 in a torch configuration, according to one or more embodiments. It should be noted that modular device 200 may include all elements of modular device 100 save base element 110, which, here, is replaced with a handle element 202. In one or more embodiments, akin to base element 110, handle element 202 may be decoratively patterned. In one or more embodiments, handle element 202 may include a stem portion 204 configured to enable user 150 to hold the torch through hand 152 thereof.

In one or more embodiments, stem portion 204 may also be longer than the depiction thereof in FIG. 2 and/or may include other components such as but not limited to an extension pole, one or more connectors and a stake (e.g., with a sharp edge useful for staking the torch). In one or more embodiments, the longer version of stem portion 204 may enable user 150 to stake the torch into a surface (to be discussed below; e.g., grass, a pathway). In some embodiments, the stakeable torch configuration of modular device 200 may find decorative/aesthetic purpose as a tiki-torch. All reasonable variations are within the scope of the exemplary embodiments discussed herein.

Again, in one or more embodiments, handle element 202 may be regarded as a module of modular device 200. Again, as discussed above, said modularity may enable easier replacement of components of modular device 200 than replacing/fixing components in an integrally formed torch configuration of a device. In one or more embodiments, stem portion 204 of handle element 202 may be configured to be held by hand 152 of user 150 and/or received through a receptacle (e.g., a recess in a wall, a ground surface; to be discussed below). It should be noted that, also in the torch configuration, modular device 200 may be without hook element 108. For the aforementioned purpose, in one implementation, hook element 108 may be removable.

Figure 3:
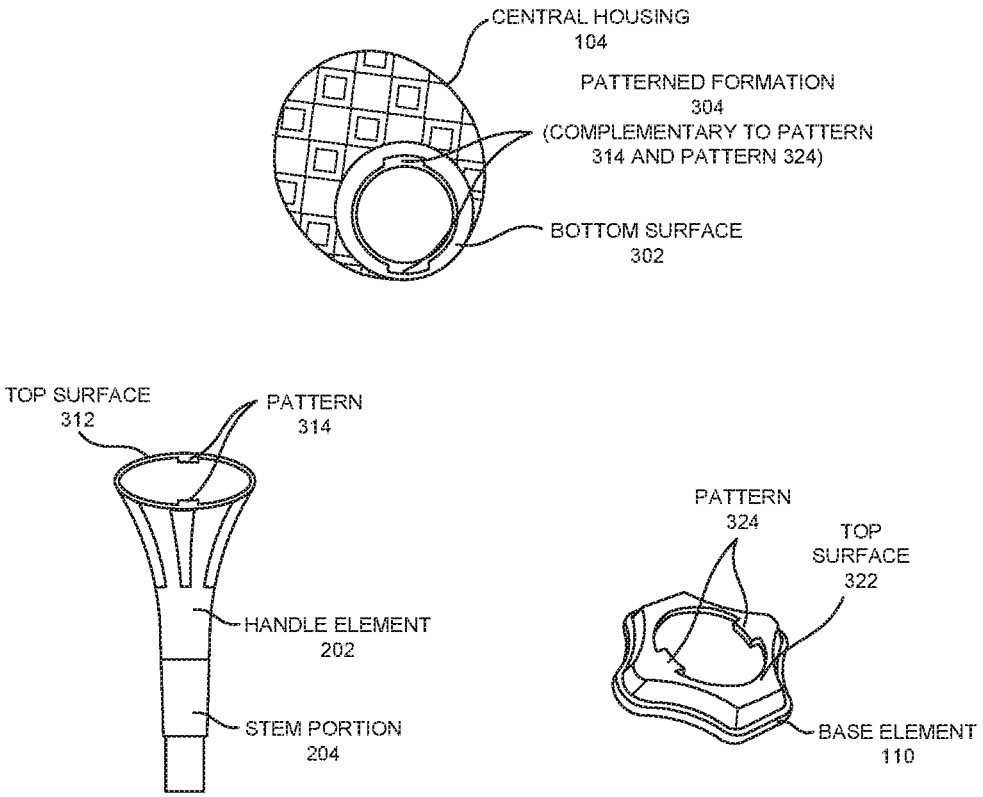
FIG. 3 is an illustrative view of enablement of coupling between a central housing of the modular devices of FIGS. 1 and 2 and each of a base element of the modular device of FIG. 1 and a handle element of the modular device of FIG. 2, according to one or more embodiments.

FIG. 3 shows enablement of coupling between central housing 104 and each of base element 110 and handle element 202, according to one or more embodiments. In one or more embodiments, central housing 104 may include a patterned formation 304 on a bottom surface 302 (i.e., the surface farthest away from a surface of coupling of light housing 102 to central housing 104) thereof. In one or more embodiments, as shown in FIG. 3, a top surface 312 of handle element 202 and a top surface 322 of base element 110 may include a pattern 314 and a pattern 324 respectively. In one or more embodiments, pattern 314 and pattern 324 may both be compatible with patterned formation 304 on bottom surface 302 of central housing 104.

In other words, in one or more embodiments, pattern 314 and pattern 324 may both be complementary to patterned formation 304. For example, pattern 314 and pattern 324 may both be male members of a locking mechanism and patterned formation 304 may be a female member of the locking mechanism. Here, the connection of each of handle element 202 and base element 110 to central housing 104 may be based on the reception of a corresponding male member within the female member. In another example, each of pattern 314 and pattern 324 may include threads to enable thread based coupling to patterned formation 304 (e.g., complementary threads) of central housing 104. Other forms of pattern 314, pattern 324 and patterned formation 304 are within the scope of the exemplary embodiments discussed herein.

Figure 4:
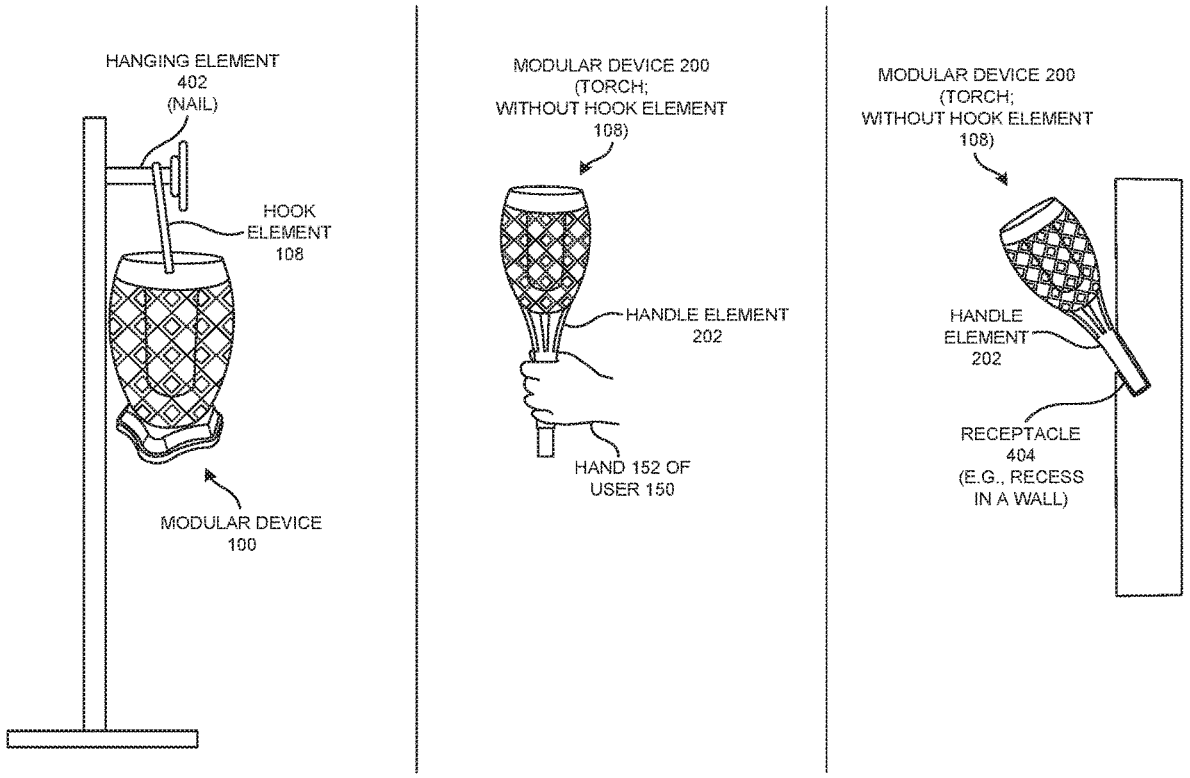
FIG. 4 is an illustrative view of example configurations of the modular devices of FIGS. 1 and 2.

FIG. 4 shows example configurations of modular device 100 and modular device 200, according to one or more embodiments. In one or more embodiments, FIG. 4 shows modular device 100 in the lantern configuration with hook element 108 hung on a hanging element 402 (e.g., a nail). Other examples of hanging element 402 may include but are not limited to a pin, a tree branch and a shepherd's hook. FIG. 4 also shows modular device 200 in the torch configuration without hook element 108 being held by hand 152 of user 150 by way of handle element 202 (e.g., stem portion 204). Further, FIG. 4 shows modular device 200 in the torch configuration without hook element 108 deposited into a receptacle 404 (e.g., a recess in a wall).

Figure 5:
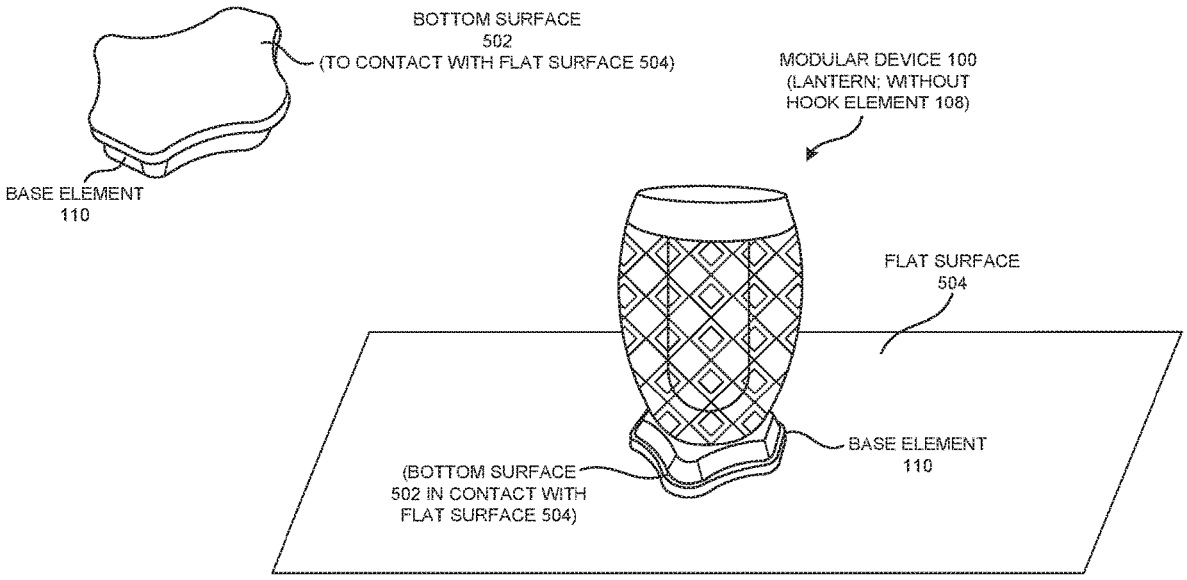
FIG. 5 is an illustrative view of the modular device of FIG. 1 in the lantern configuration placed on a flat surface, according to one or more embodiments.

FIG. 5 shows modular device 100 in the lantern configuration placed on a flat surface 504, according to one or more embodiments. In one or more embodiments, flat surface 504 may be at a ground level or a level raised above the ground level (e.g., a table). FIG. 5 shows a bottom surface 502 of base element 110 on an opposite end of an end of coupling of base element 110 to central housing 104, according to one or more embodiments. In one or more embodiments, when modular device 100 in the lantern configuration is placed on flat surface 504, bottom surface 502 of base element 110 may make appropriate surface contact with flat surface 504. All reasonable variations are within the scope of the exemplary embodiments discussed herein.

Figure 6:
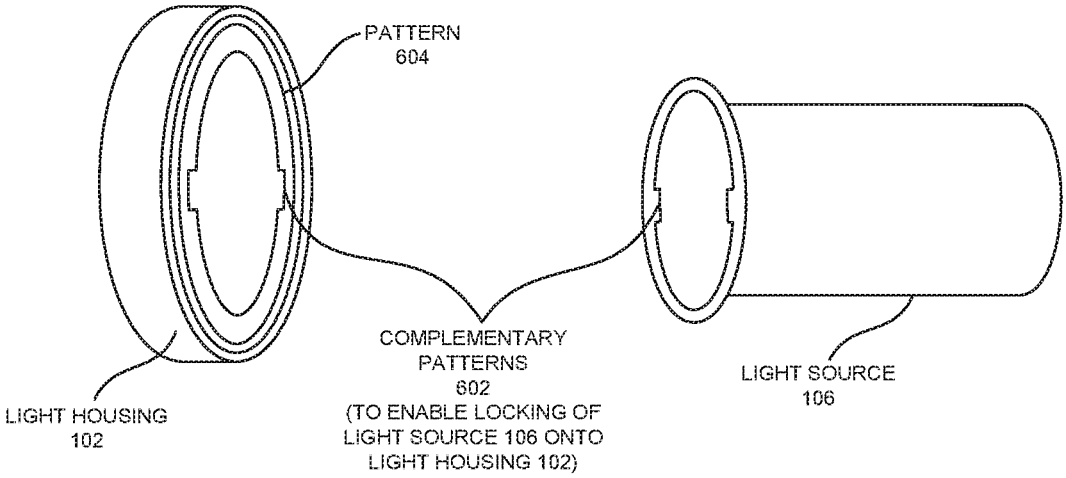
FIG. 6 is an illustrative view of a capability of coupling a light source of the modular devices of FIGS. 1 and 2 to a light housing thereof, according to one or more embodiments.

FIG. 6 shows a capability of coupling light source 106 to light housing 102, according to one or more embodiments. As shown in FIG. 6, in one or more embodiments, light source 106 and light housing 102 may have complementary patterns 602 (e.g., a male member on light source 106 configured to lock onto a female member on light housing 102) to enable reception of light source 106 in light housing 102 in accordance with locking of light source 106 onto light housing 102 based on complementary patterns 602. Again, in one or more embodiments, complementary patterns 602 may aid the modularity of modular device 100 as a number of light sources analogous to light source 106 may fit into a number of light housings analogous to light housing 102. Other forms of complementary patterns 602 (e.g., thread based) are within the scope of the exemplary embodiments discussed herein.

In one or more embodiments, the changeability of light source 106 may be enabled through complementary patterns 602. For example, a red LED lamp (example light source 106) may be replaced with a green LED lamp (another example light source 106). In addition, in one or more embodiments, light housing 102 may be replaced with another light housing (not shown) analogous to light housing 102. For example, said another example light source 106 may be coupled to the another light housing.

FIG. 6 also shows pattern 604 on light housing 102 configured to enable connection of light housing 102 to central housing 104. In one example implementation, pattern 604 may enable reception of light housing 102 with light source 106 within central housing 104 based on a complementary pattern (not shown) on light housing 102. Again, various forms of pattern 604 are within the scope of the exemplary embodiments discussed herein.

Figure 7:
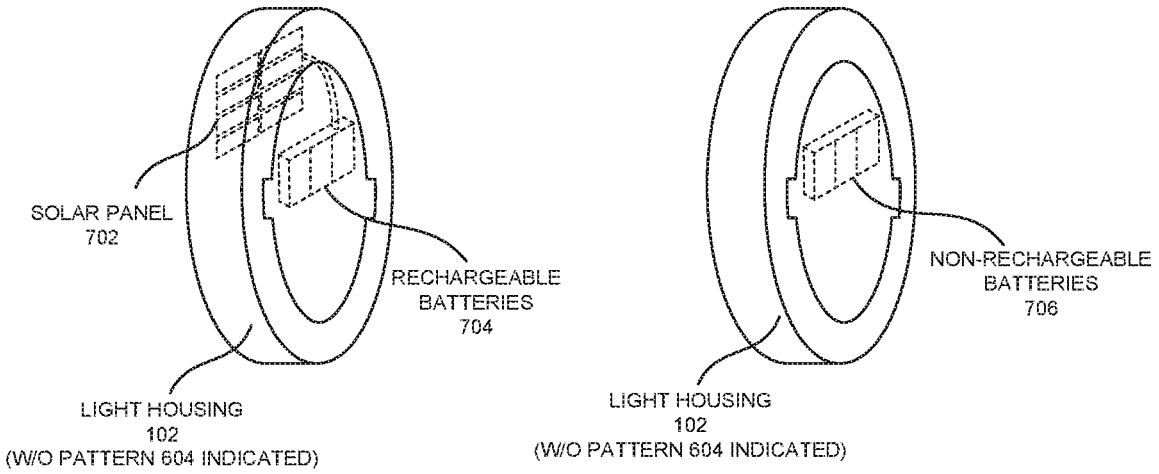
FIG. 7 is an illustrative view of one or more power source(s) embedded/accommodated within the light housing of the modular devices of FIGS. 1 and 2, according to one or more embodiments.

FIG. 7 shows one or more power source(s) embedded/accommodated within light housing 102, according to one or more embodiments. In one or more embodiments, light housing 102 may have a solar panel 702 embedded/accommodated therein configured to enable charging of rechargeable batteries 704. In one or more embodiments, rechargeable batteries 704 may, in turn, power light source 106 of FIGS. 1-2. In one or more other embodiments, rechargeable batteries 704 may be charged through an external source and embedded/accommodated within light housing 102. In this implementation, solar panel 702 may not be required.

In one or more embodiments, as shown in FIG. 7, light housing 102 may instead include non-rechargeable batteries 706 to power light source 106 of FIGS. 1-2. In some embodiments, it is possible that light housing 102 may include solar panel 702, rechargeable batteries 704 and non-rechargeable batteries 706. All reasonable variations are within the scope of the exemplary embodiments discussed herein. Again, the arrangements associated with embedding solar panel 702, rechargeable batteries 704 and non-rechargeable batteries 706 may be based on modularization, thereby implying that each of the aforementioned components may serve as distinct units that are replaceable with other components with similar characteristics.

Figure 8:
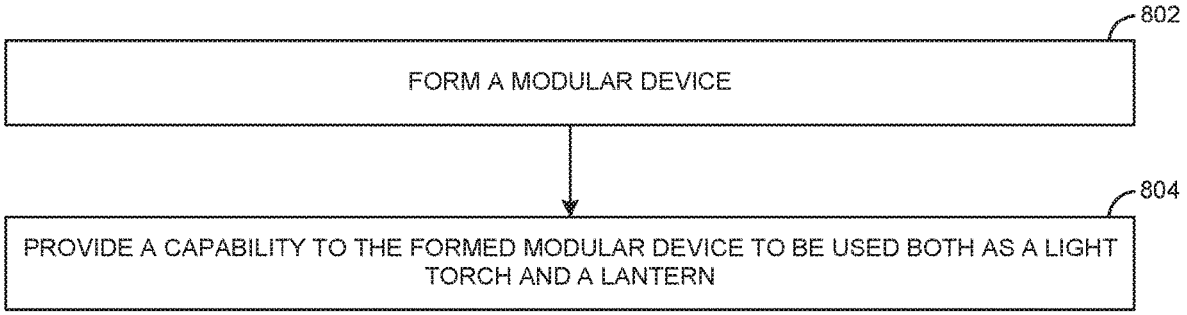
FIG. 8 is a process flow diagram detailing the operations involved in realizing a modular device with interchangeable torch-lantern functionalities, according to one or more embodiments.

FIG. 8 shows a process flow diagram detailing the operations involved in realizing a modular device (e.g., modular device 100, modular device 200) with interchangeable torch-lantern functionalities, according to one or more embodiments. In one or more embodiments, operation 802 may involve forming the modular device based on providing a light housing (e.g., light housing 102) configured to receive a light source (e.g., light source 106) thereon, and providing a central housing (e.g., central housing 104), decoratively patterned and configured to be connected to the light housing such that, in a state of the connection of the light housing with the received light source to the central housing, the light source is also received through the central housing and encompassed by the central housing with the decorative patterning thereon.

In one or more embodiments, operation 804 may then involve providing a capability to the formed modular device to be used both as a torch and a lantern based on providing a patterned formation (e.g., patterned formation 304) on a bottom surface (e.g., bottom surface 302) of the central housing farthest away from the light housing compatible with a complementary pattern (e.g., pattern 314, pattern 324) on a top surface (e.g., top surface 312, top surface 322) of each of a handle element (e.g., handle element 202) and a base element (e.g., base element 110). In one or more embodiments, the handle element may include a stem portion (e.g., stem portion 204) configured to be held by a hand (e.g., hand 152) of a user (e.g., user 150) of the modular device and/or received through a receptacle (e.g., receptacle 404), and the base element may be configured to enable placement of the lantern on a flat surface (e.g., flat surface 504) based on appropriate surface contact between a bottom surface (e.g., bottom surface 502) of the base element and the flat surface.

In one or more embodiments, operation 804 may also involve providing the capability to the formed modular device to be used both as the torch and the lantern based on connecting the handle element to the central housing based on the complementary patterns thereon to enable the use of the modular device as the torch, and connecting the base element to the central housing based on the complementary patterns thereon to enable the use of the modular device as the lantern.

Figure 9:
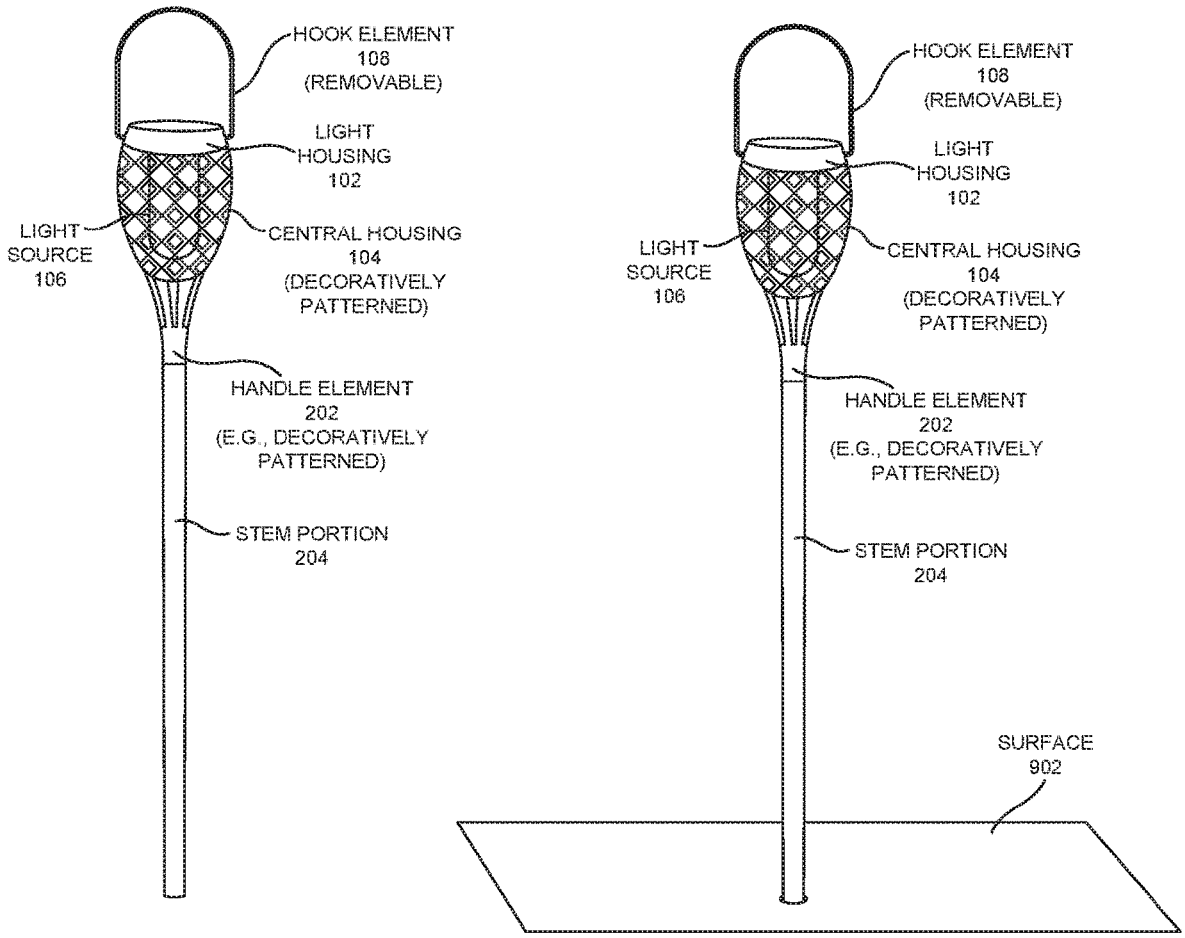
FIG. 9 is an illustrative view of a tiki-torch configuration of the modular device of FIG. 2, according to one or more embodiments.

FIG. 9 shows a tiki-torch configuration of modular device 200, according to one or more embodiments. Here, in one or more embodiments, stem portion 204 of handle element 202 may be long enough to enable staking of modular device 200 into a surface 902 (another example receptacle 404). While surface 902 preferably may be a flat surface, surface 902 may also be an uneven, muddy surface into which it is easy to stake stem portion 204 of handle element 202 of modular device 200.

Again, it should be noted that stem portion 204 may be associated with an extension pole, one or more connectors and a stake (e.g., with a sharp point, screw-based), which may be regarded as part of stem portion 204/handle element 202. All of the aforementioned components including handle element 202 and stem portion 204 may be regarded as modules of modular device 200.

Figure 10:
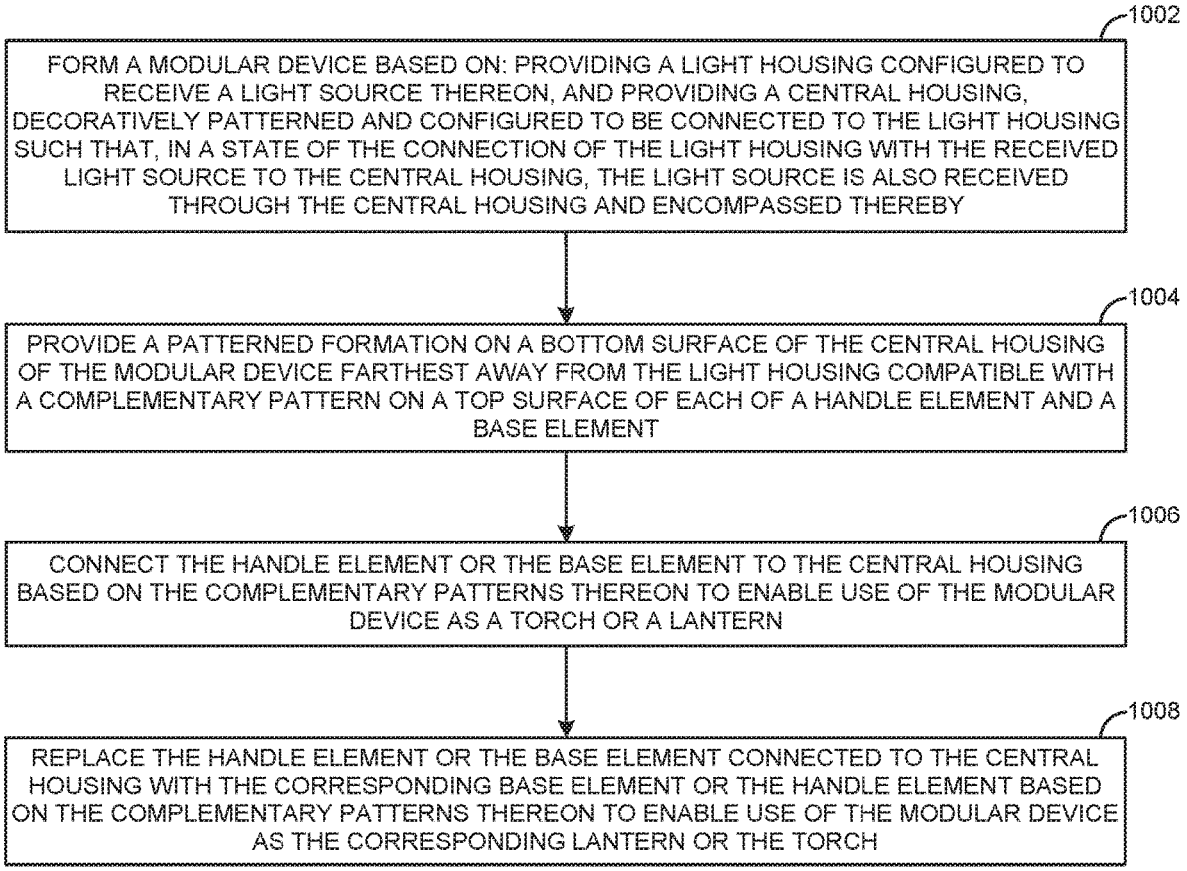
FIG. 10 is another process flow diagram detailing the operations involved in realizing a modular device with interchangeable torch-lantern functionalities, according to one or more embodiments.

FIG. 10 shows another process flow diagram detailing the operations involved in realizing a modular device (e.g., modular device 100, modular device 200) with interchangeable torch-lantern functionalities, according to one or more embodiments. In one or more embodiments, operation 1002 may involve forming the modular device based on providing a light housing (e.g., light housing 102) configured to receive a light source (e.g., light source 106) thereon, and providing a central housing (e.g., central housing 104), decoratively patterned and configured to be connected to the light housing such that, in a state of the connection of the light housing with the received light source to the central housing, the light source is also received through the central housing and encompassed by the central housing with the decorative patterning thereon.

In one or more embodiments, operation 1004 may involve providing a patterned formation (e.g., patterned formation 304) on a bottom surface (e.g., bottom surface 302) of the central housing of the modular device farthest away from the light housing compatible with a complementary pattern (e.g., pattern 314, pattern 324) on a top surface (e.g., top surface 312, top surface 322) of each of a handle element (e.g., handle element 202) and a base element (e.g., base element 110). In one or more embodiments, the handle element may include a stem portion (e.g., stem portion 204) configured to be held by a hand (e.g., hand 152) of a user (e.g., user 150) of the modular device and/or received through a receptacle (e.g., receptacle 404), and the base element may be configured to enable placement of the modular device on a flat surface (e.g., flat surface 504) based on appropriate surface contact between a bottom surface (e.g., bottom surface 502) of the base element and the flat surface.

In one or more embodiments, operation 1006 may involve connecting the handle element or the base element to the central housing based on the complementary patterns thereon to enable use of the modular device as a torch or a lantern. In one or more embodiments, operation 1008 may then involve replacing the handle element or the base element connected to the central housing with the corresponding base element or the handle element based on the complementary patterns thereon to enable use of the modular device as the corresponding lantern or the torch.

Thus, in one or more embodiments, the modularization of components of modular device 100/200 may not only provide advantages to manufacturers who only need to produce components with appropriate patterns that are interchangeable with existing components but also to users (e.g., user 150) of modular device 100/200 who are empowered to swap components for not only utilitarian purposes but also aesthetic ones. For example, user 150 may swap out light housing 102 and/or replace a current red LED lamp as light source 106 with a green LED lamp as light source 106. In another example, user 150 may swap out the decorative patterning of central housing 104 from a current pattern of butterflies to another pattern of, say, pumpkins for Halloween. All reasonable variations are within the scope of the exemplary embodiments discussed herein.

Although the present embodiments have been described with reference to specific example embodiments, it will be evident that various modifications and changes may be made to these embodiments without departing from the broader spirit and scope of the various embodiments. Accordingly, the Specification and drawings are to be regarded in an illustrative rather than a restrictive sense.

What is claimed is:

1. A modular device comprising:

a light housing to receive a light source thereon;

a central housing to receive decorative patterns such that the central housing forms an enclosure with the decorative patterns as a barrier of the enclosure, the central housing with the decorative patterns connected to the light housing such that the light source is received through the central housing with the decorative patterns and encompassed by the central housing with the decorative patterns thereon, with the decorative patterns being modular and distinct from the central housing, and the modular decorative patterns providing for controlled environmental illumination from the light source;

a handle element; and a base element, wherein a bottom surface of the central housing farthest away from the light housing comprises a patterned formation thereon to connect the handle element to the central housing in a first mode of operation of the modular device and the base element to the central housing in a second mode of operation of the modular device by way of the same patterned formation on the bottom surface of the central housing based on each of the handle element and the base element having a pattern on a top surface thereof that is complementary to the patterned formation on the bottom surface of the central housing such that:

the modular device is used as a torch in the first mode of operation, and the modular device is a lantern in the second mode of operation, wherein the handle element comprises a stem portion to be at least one of: held by a hand of a user of the modular device and received through a receptacle, wherein the base element enables placement of the lantern on a flat surface based on appropriate surface contact between a bottom surface of the base element and the flat surface, and wherein the light housing and the central housing are removably connected to one another, the light source is removably connected to the light housing and the modular decorative patterns are removably connected to the central housing such that each of the light housing, the central housing, the modular decorative patterns and the light source is replaceable with a corresponding each of another light housing, another central housing, other modular decorative patterns and another light source independent of any other component of the modular device.

2. The modular device of claim 1, wherein the light housing further comprises a hook element connected thereto to enable at least one of: hanging of the modular device on an appropriate hanging element and holding of the modular device via the hand of the user thereof.

3. The modular device of claim 1, wherein, to power the light source, the light housing accommodates at least one of:

at least one solar panel with at least one rechargeable battery, and at least one non-rechargeable battery.

4. The modular device of claim 1, wherein at least one of: the handle element and the base element is also decoratively patterned.

5. The modular device of claim 1, wherein the light source is received on the light housing in accordance with locking of the light source onto the light housing based on complementary patterns thereon.

6. The modular device of claim 1, wherein the stem portion of the handle element is long enough for the modular device to be staked into a surface, the surface being the receptacle.

7. A method of a modular device comprising:

forming the modular device based on:

receiving a light source on a light housing, receiving modular decorative patterns on a central housing such that the central housing forms an enclosure with the modular decorative patterns as a barrier of the enclosure, connecting the central housing with the modular decorative patterns to the light housing such that the light source is received through the central housing with the modular decorative patterns and encompassed by the central housing with the modular decorative pattern thereon, providing for controlled environmental illumination from the light source based on the modular decorative patterns, and providing a handle element se element distinct from one another;

rendering the formed modular device as a torch in a first mode of operation thereof and a lantern in a second mode of operation thereof based on:

providing a patterned formation on a bottom surface of the central housing farthest away from the light housing compatible with a complementary pattern on a top surface of each of the handle element and the base element, the handle element comprising a stem portion to be at least one of: held by a hand of a user of the modular device and received through a receptacle, and the base element enabling placement of the lantern on a flat surface based on appropriate surface contact between a bottom surface of the base element and the flat surface, connecting the handle element to the central housing based on the complementary patterns thereon to render the modular device as the torch in the first, lode of operation, and connecting the base element to the central housing based on the complementary patterns thereon to render the modular device as the lantern in the second mode of operation; and removably connecting the light housing and the central housing to one another, the light source and the light housing to one another, and the modular decorative patterns and the central housing to one another such that each of the light housing, the central housing, the modular decorative patterns and the light source is replaceable with a corresponding each of another light housing, another central housing, other modular decorative patterns and another light source independent of any other component of the formed modular device.

8. The method of claim 7, further comprising providing the light housing with a hook element to enable at least one of: hanging of the modular device on an appropriate hanging element and holding of the modular device via the hand of the user thereof.

9. The method of claim 7, further comprising powering the light source through at least one of:

at least one solar panel with at least one rechargeable battery, and at least one non-rechargeable battery.

10. The method of claim 7, farther comprising decoratively patterning at least one of: the handle element and the base element.

11. The method of claim 7, comprising locking the light source onto the light housing based on complementary patterns thereon to effect the reception of the light source on the light housing.

12. The method of claim 7, comprising providing the stem portion of the handle element long enough for the modular device to be staked into a surface, the surface being the receptacle.

13. A method of a modular device comprising:

forming the modular device based on:

receiving a light source a light housing, receiving modular decorative patterns on a central housing such that the central housing forms an enclosure with the modular decorative patterns as a barrier of the enclosure, connecting the central housing with the modular decorative patterns to the light ho using such that the light source is received through the central housing with the modular decorative patterns and encompassed by the central housing with the modular decorative patterns thereon, providing for controlled environmental illumination from the light source based on e modular decorative patterns, and providing a handle element and a base element distinct from one another;

providing a patterned formation on a bottom surface of the central housing of the modular device farthest away from the light housing compatible with a complementary pattern on a top surface of each of the handle element and the base element, the handle element comprising a stem portion to be at least one of: held by a hand of a user of the modular device and received through a receptacle, and the base element enabling placement of the modular device on a flat surface based on appropriate surface contact between a bottom surface of the base element and the flat surface;

connecting the handle element to the central housing based on the complementary pattern on the top surface of the handle element and the patterned formation on the bottom surface of the central housing to render the modular device as a torch in a first mode of operation of the formed modular device;

replacing the handle element with the base element in accordance with connection of the base element to the central housing based on the complementary pattern on the top surface of the base element and the same patterned formation on the bottom surface of the central housing to render the modular device as a lantern in a second mode of operation of the formed modular device; and removably connecting the light housing and the central housing to one another, the light source and the light housing to one another, and the modular decorative patterns and the central housing to one another such that each of the light housing, the central housing, the modular decorative patterns and the light source is replaceable with a corresponding each of another light housing, another central housing, other modular decorative patterns and another light source independent of any other component of the formed, modular device.

14. The method of claim 13, further comprising providing the light housing with a hook element to enable at least one of: hanging of the modular device on an appropriate hanging element and holding of the modular device via the hand of the user thereof.

15. The method of claim 13, further comprising powering the light source through at least one of:

at least one solar panel with at least one rechargeable battery, and at least one non-rechargeable battery.

16. The method of claim 13, further comprising decoratively patterning at least one of: the handle element and the base element.

17. The method of claim 13, comprising at least one of:

locking the light source onto the light housing based on complementary patterns thereon to effect the reception of the light source on the light housing; and providing the stem portion of the handle element long enough for the modular device to be staked into a surface, the surface being the receptacle.

* * * * *